United States Patent [19]

Kinoshita et al.

[11] Patent Number: 5,063,410

[45] Date of Patent: Nov. 5, 1991

[54] IMAGE FORMING APPARATUS HAVING A PLURALITY OF REMOVABLE DEVELOPING DEVICES

[75] Inventors: Naoyoshi Kinoshita; Keiji Kusumoto, both of Osaka, Japan

[73] Assignee: Minolta Camera Kabushiki Kaisha, Osaka, Japan

[21] Appl. No.: 477,462

[22] Filed: Feb. 9, 1990

[30] Foreign Application Priority Data

Feb. 10, 1989 [JP] Japan ..... 1-31955

[51] Int. Cl.[5] ..... G03G 21/00

[52] U.S. Cl. ..... 355/204; 355/245; 355/326

[58] Field of Search ..... 355/326, 327, 328, 208, 355/204, 206, 245

[56] References Cited

U.S. PATENT DOCUMENTS

| | | | |
|---|---|---|---|
| 4,579,443 | 4/1986 | Abuyama et al. | 355/314 |
| 4,769,675 | 9/1988 | Watanabe | 355/328 X |
| 4,845,524 | 7/1989 | Okamoto et al. | 355/328 X |
| 4,890,139 | 12/1989 | Takebe | 355/244 X |

FOREIGN PATENT DOCUMENTS

| | | | |
|---|---|---|---|
| 950767 | 7/1974 | Canada . | |
| 61-256357 | 11/1986 | Japan . | |
| 0255976 | 11/1987 | Japan | 355/245 |
| 0213868 | 9/1988 | Japan | 355/245 |

*Primary Examiner*—A. T. Grimley
*Assistant Examiner*—Sandra L. Hoffman
*Attorney, Agent, or Firm*—Burns, Doane, Swecker & Mathis

[57] ABSTRACT

The present invention discloses an image forming apparatus capable of making color reproductions. A plurality of developing portions are arranged around a photoreceptor which rotates in a predetermined direction. Developing units, which accommodate different kinds of developer, can be attached to the developing portions. Switches detect the attachment of at least one of the developing units. During a copying operation an electrostatic latent image is formed on an electroconductive drum and toner adheres to the electrostatic latent image by selectively operating the developing units.

14 Claims, 12 Drawing Sheets

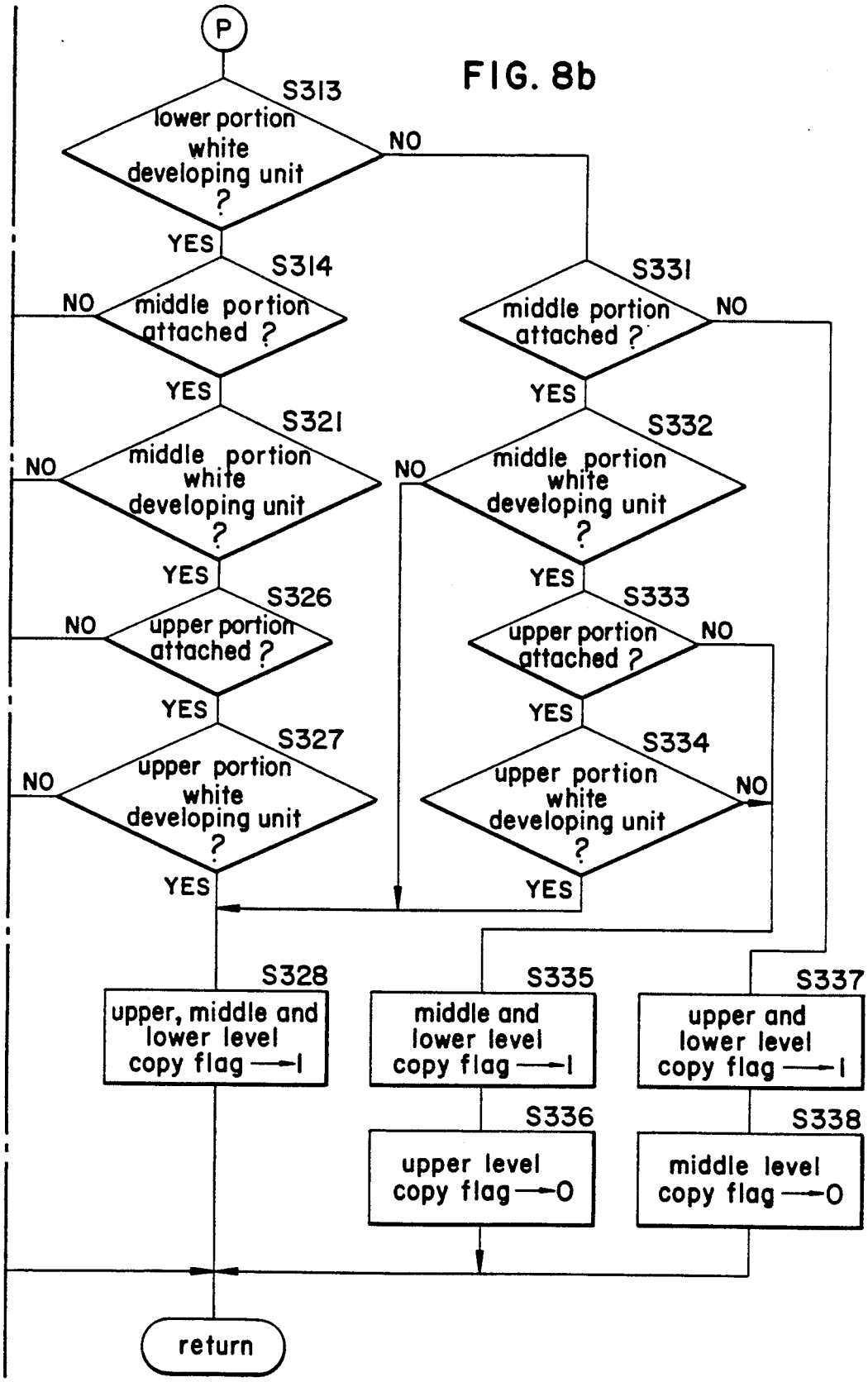
P
FIG. 8b
S313
lower portion white developing unit ?
NO
YES
S314
middle portion attached ?
NO
YES
S321
middle portion white developing unit ?
NO
YES
S326
upper portion attached ?
NO
YES
S327
upper portion white developing unit ?
NO
YES
S331
middle portion attached ?
NO
YES
S332
middle portion white developing unit ?
NO
YES
S333
upper portion attached ?
NO
YES
S334
upper portion white developing unit ?
NO
YES
S328
upper, middle and lower level copy flag →1
S335
middle and lower level copy flag →1
S336
upper level copy flag →0
S337
upper and lower level copy flag →1
S338
middle level copy flag →0
return

IMAGE FORMING APPARATUS HAVING A PLURALITY OF REMOVABLE DEVELOPING DEVICES

BACKGROUND OF THE INVENTION

1. Field of the Invention

The present invention relates to an image forming apparatus having a plurality of removable developing devices.

2. Description of the Relates Arts

There have been numerous proposals in recent years for multicolor copy machines, that is, copy machines using electrophotographic methods have been provided with multiple developing devices which could be selectably operated to produce copies in specified colors. In the aforesaid type of multicolor copy machine, there is an inherent problem of color mixing by the toner accommodated in the developing devices. This problem is an unavoidable problem associated with electrophotographic methods.

When color mixing occurs, particularly when, for example, black or other color toner is introduced into a developing device accommodating white toner, the white toner is contaminated so that the white toner darkens and a pure white toner color is unavailable. Thus, when a white developing device is installed, said device is installed so as to be disposed above the installation position of the color developing devices, thereby preventing as far as possible the introduction of toner overflowing from a color developing device into the white developing device and contamination of the white developing device by toner from a color developing device via the rotation of the photoconductive drum.

In image forming apparatus that can accommodate the installation of multiple developing devices, however, user error may lead to the image forming apparatus being operated after the operator mistakenly installs a color developing device at a position above the white developing device.

SUMMARY OF THE INVENTION

A main object of the present invention is to provide an image forming apparatus capable of making suitable color reproductions.

Other object of the present invention is to provide an image forming apparatus capable of accomplishing adequent white toner effectiveness.

A further object of the present invention is to provide an image forming apparatus that can be used without contaminating the white color toner by color mixing, even when a developing device accommodating a nonwhite color toner is installed so as to be disposed above a developing device accommodating a white color toner.

A still further object of the present invention is to provide an image forming apparatus that can be used without contaminating the white color toner by color mixing, even when a user selects by mistake the operation of the developing portion to which a developing device accommodating a nonwhite color toner is attached.

These objects of the present invention are accomplished by providing an image forming apparatus having a photoreceptor rotatable in a predetermined direction;

a plurality of developing portions arranged one by one in the direction of the photoreceptor rotation;

a plurality of developing units attachable to the developing portions respectively for accommodating different kinds of developer;

detecting means for detecting the attachment of the developing unit accommodating a specific kind of developer; and control means responsive to said detecting means for regulating the operation of the developing portions to which the developing units accommodating the developer except for the specific kind of developer are attached.

These and other objects, advantages and features of the invenion will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE DRAWINGS

The first embodiment of the present invention is hereinafter described with reference to FIGS. 1 through 10.

Figure 1:
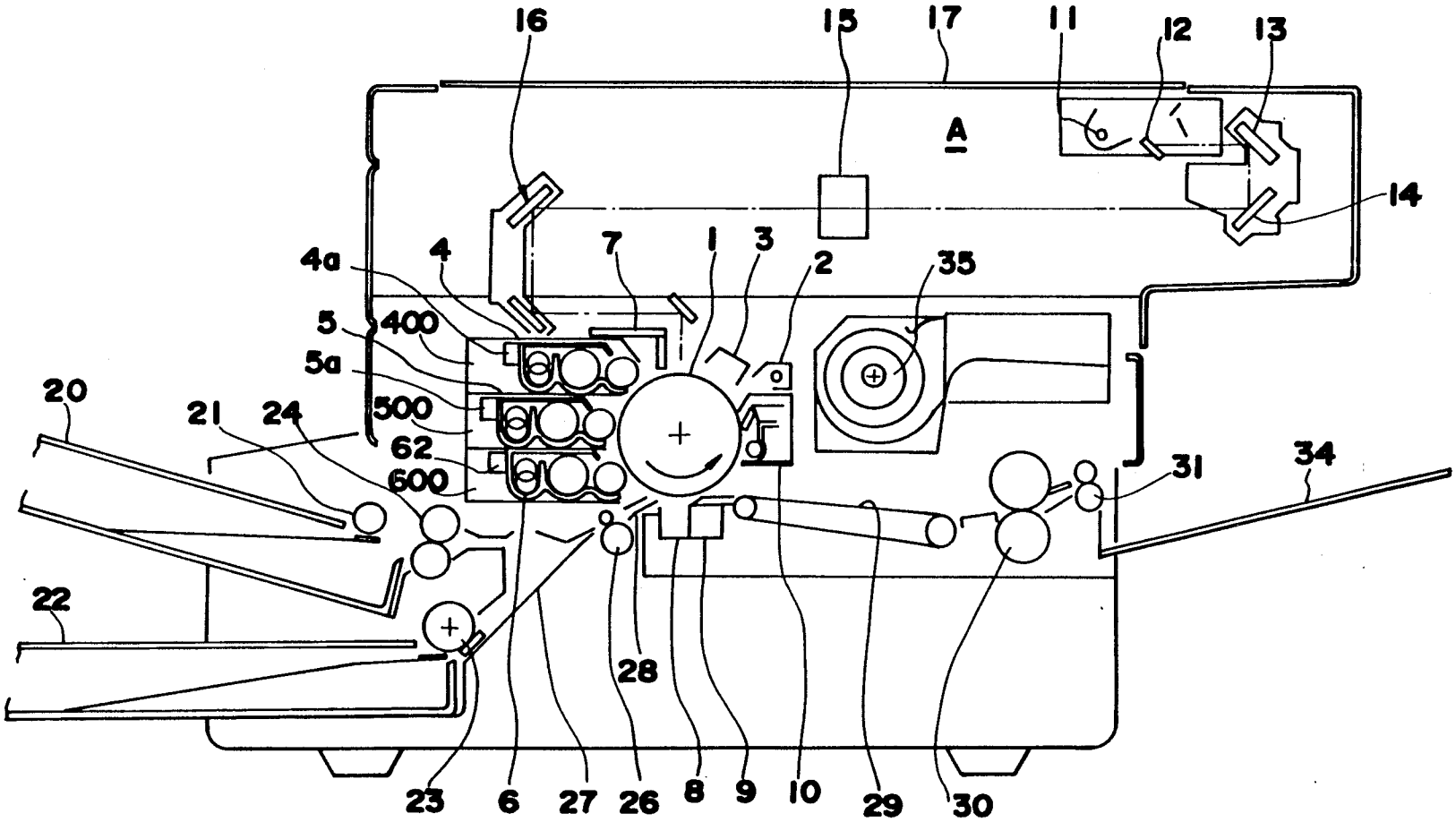
FIG. 1 is a brief cross section view of a first embodiment of the image forming apparatus of the present invention.

FIG. 1 is a brief cross section view showing the first embodiment of the image forming apparatus of the present invention installed in a copy machine.

A drivably rotatable photoconductive drum 1 is provided in the center of a copy machine, and arranged counterclockwise around the aforesaid photoconductive drum 1 is a main eraser lamp 2, charger 3, light-emitting diode (LED) 7, vertically arrayed upper, middle and lower developing portions 400, 500 and 600, transfer charger 8, copy sheet separation charger 9, and blade-type cleaning device 10; and the aforesaid developing portions 400, 500 and 600 are provided removably developing devices 4, 5 and 6 respectively. The aforesaid developing devices 4, 5 and 6 are disposed in discrimination portions 4*a*, 5*a* and 6*a* to discriminate the color of the toners respectively accommodated therein. Discrimination portions 4*a*,5*a* and 6*a* comprise dip switches or the like activated when toner is replenished. In the present embodiment, toner color is discriminated by combinations of high and low input signals comprising 3-bit codes from the aforesaid dip switches input to a one-chip computer 200, as is the presence of developing devices 4, 5 and 6.

The toner color discrimination portion is provided separate detection switches for detecting the presence of the installed developing devices in each of the developing portions, and the detection signals of said detection switches may also be input to the one-chip computer 200.

The surface of photoconductive drum 1 is provided a photoconductive layer and is drivably rotatable in the counterclockwise direction in FIG. 1. With each copy process, the surface of photoconductive drum 1 is exposed to light by eraser lamp 2, charged as it passes charger 3, and subjected to image exposure from optical unit A. Optical unit A is capable of scanning an original document image from below document glass platen 17, and comprises a light source 11, movable mirrors 12, 13 and 14, lens 15, and mirror 16.

On the other hand, on the left side of the copy machine in FIG. 1 are disposed upper and lower paper entrances respectively provided with paper supplying rollers 21 and 23, and top paper cassette 20 and bottom paper cassette 22. The copy sheet transport paths for the sheets accommodated in cassettes 20 and 22 comprise a pair of rollers 24, pair of timing rollers 26, sheet guide plate 27, guide plate 28 immediately in front of the transfer position, transport belt 29, fixing device 30, and a pair of discharge rollers 31.

The original document arranged on top of document glass platen 17 is scanned by the previously described optical unit A, and the original document image converges on the surface of photoconductive drum 1 through the mirror and lenses so as to receive the image exposure, thereby forming an electrostatic latent image on the surface of said drum 1. Toner is adhered to the aforesaid electrostatic latent image by selectively operating the aforesaid developing units 4, 5 and 6, and the resulting toner image on the photoconductive drum 1 is transferred via a transfer charger 8 to a copy sheet transported by the previously mentioned pair of timing rollers 26 so that the leading edge of said copy sheet aligns with the toner image region. After the image transfer the copy sheet is separated from the surface of photoconductive drum 1 by separation charger 9, transported by transport belt 29 to fixing unit 30 where the toner image is fused to said sheet, and thereafter transported to discharge tray 34 by a pair of discharge rollers 31. Item 35 is the main motor that drives photoconductive drum 1, paper supplying rollers 21 and 23, roller pair 24, timing roller pair 26, developing units 4, 5 and 6, transport belt 29, fixing unit 30, and discharge roller pair 31. The drive force of main motor 35 is switchably transmitted and nontransmitted via a solenoid, electromagnetic spring clutch or the like (not shown in the drawing) so as to allow independent operation of the aforesaid paper supplying rollers 21 and 23, timing roller pair 26, roller pair 24, and developing units 4, 5 and 6.

Figure 2:
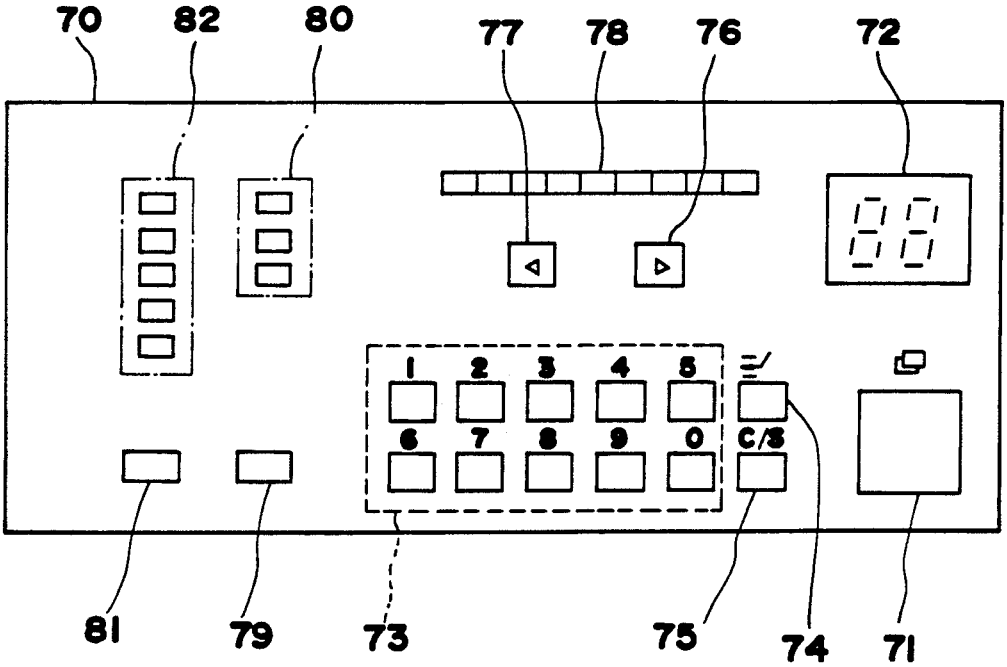
FIG. 2 is a plan view of control panel 70 of the first embodiment of the image forming apparatus of the present invention.

FIG. 2 is a plan view of the copy machine control panel which has a PRINT button 71 for starting the copy operation, numerical display LED for indicating the copy number, a ten-key pad 73 for setting the copy number, INTERRUPT key 74, CLEAR/STOP key 75, exposure setting UP and DOWN keys 76 and 77, exposure display LED group 78, developing portion selecting key 79, color display LED group 80 for displaying the toner color of the developing unit installed in the selected developing portion, paper selection key 81, and paper selection display LED group 82.

The operator can select the desired developing portion by switching the developing portions by depressing the developing portion selecting key 79. The color of the toner accommodated in the developing unit installed in the selected developing portion is then shown on color display LED 80.

The construction and operation of the developing units selected via the developing unit selecting key 79 on the control panel 70 is hereinafter described with reference to FIGS. 3 through 5.

The construction of developing units 4, 5 and 6 installed in upper, middle and lower developing portions 400, 500 and 600 is identical. In developing tank 100 from the photoconductive drum 1 side are arranged developing sleeve 101, shutter 102, bucket roller 103, and screw 104. In the interior of developing sleeve 101 is provided a magnet roller 105 having a plurality of magnets arranged in the axial direction.

When one of the multiple developing units is operated, for example, developing unit 4 in the upper developing portion 400, and the toner heads formed on developing sleeve 101 of developing units 5 and 6 in the middle and lower developing portions touch photoconductive drum 1, the toner image formed by the toner supplied from developing unit 4 in the upper developing portion is disturbed. Further, when developing units 5 and 6 in the middle and lower developing portions are operated, the toner head formed on developing sleeve 101 of developing unit 4 in the upper developing portion makes contact with the electrostatic latent image formed on photoconductive drum 1, and develops slightly even if the sleeve 101 does not rotate.

Therefore, a shutter 102 is arranged between developing sleeve 101 and bucket roller 103 so that when a developing unit is not selected, shutter 102 is actuated to block the supply of toner to developing sleeve 101

Figure 5:
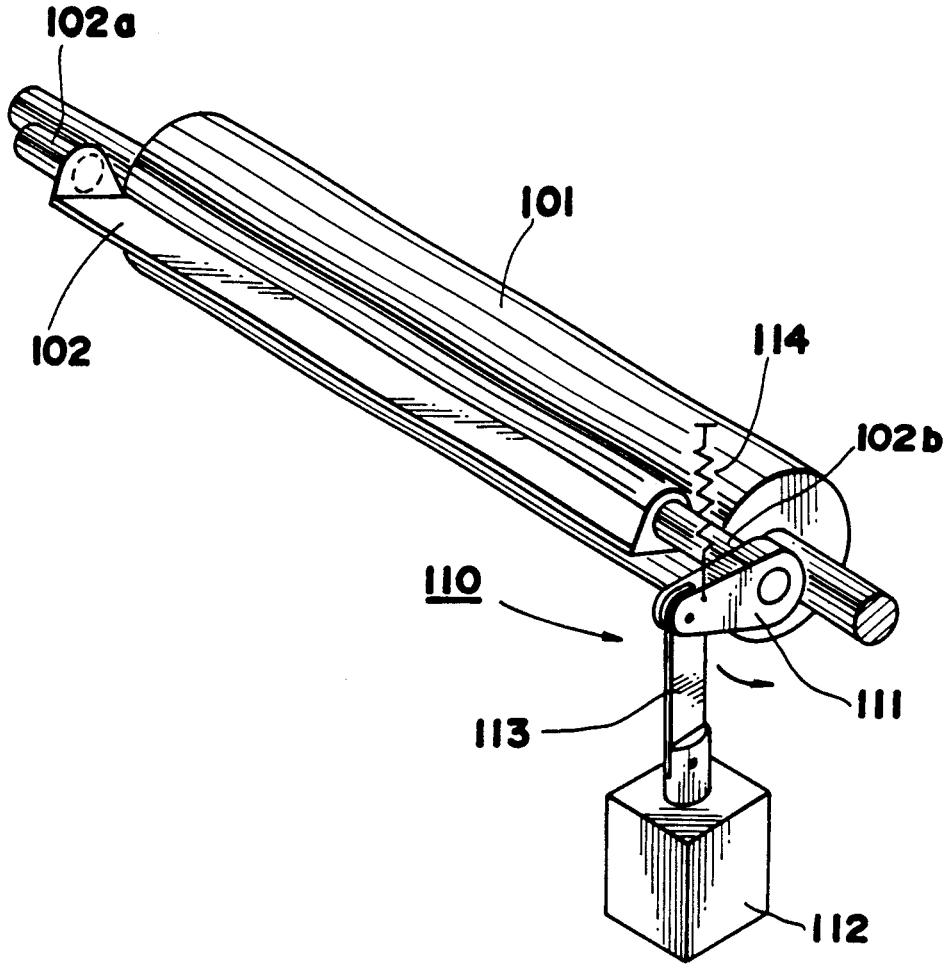
FIG. 5 is a perspective view showing the drive mechanism of shutter 102.

Drive mechanism 110 for shutter 102 is constructed as shown in FIG. 5. Shutter 102 is arranged along developing sleeve 101 and has a shaft 102*a* and a shaft 102*b* provided at either end which are supported by the casing of developing tank 100. A lever 111 is attached to shaft 102*b*, the tip of said lever 111 being connected to a plunger 113 attached to solenoid 112. One end of lever 111 is stopped by spring 104 attached to the casing of developing tank 100, so that during developing the posture of shutter 102 is as shown in FIG. 3.

Figure 4:
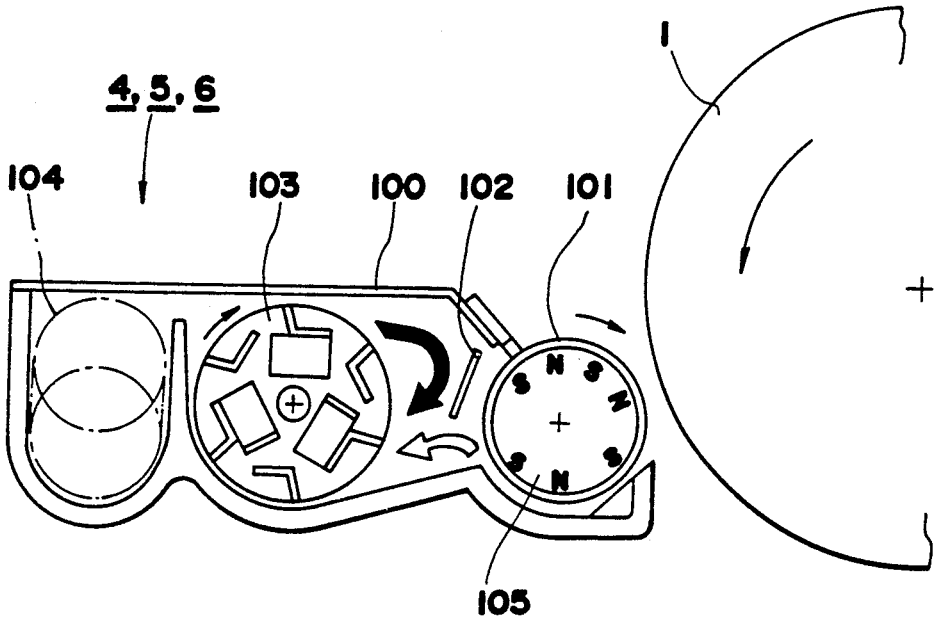

When developing portion 400, 500 or 600 is selected using the developing portion selecting key 79 on control panel 70, the solenoids 112 of the developing units installed in the non-selected developing portions are switched ON, plunger 113 is pulled against the resistance of spring 114, and the posture of shutter 102 changes as shown in FIG. 4. Toner supply to developing sleeve 101 via the rotation of bucket roller 103 is completely blocked as indicated by the black arrow in FIG. 4. The toner on developing sleeve 101 moves with the rotation of developing sleeve 101, and when said toner arrives at the nonmagnetic or weak magnetic force region on the side opposite the side confronting the photoconductive drum 1, said toner is scraped from developing sleeve 101 and recovered by bucket roller 103. Because toner supply to the rotating developing sleeve 101 is completely interrupted at this time, there is no effect either to the toner image or the electrostatic latent image formed on photoconductive drum 1.

When the toner is completely recovered from developing sleeve 101 and the rotation of said developing sleeve 101 is stopped, solenoid 112 is switched OFF, shutter 102 returns to the original shutter position, and developing sleeve 101 is maintained without toner thereon.

Figure 3:
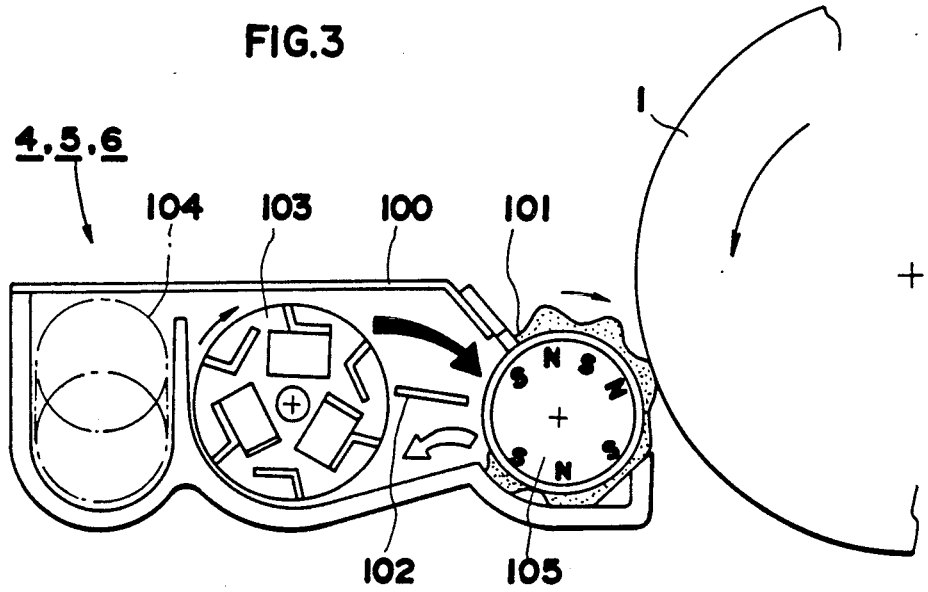
FIGS. 3 and 4 are section views of a developing device.

On the other hand, shutter 102 of the developing unit in the selected developing portion is maintained in the posture shown in FIG. 3 by switching solenoid 112 OFF and toner is supplied from bucket roller 103 along shutter 102 to developing sleeve 101 as it starts rotation, as indicated by the black arrow in FIG. 3, toner heads are sequentially formed on developing sleeve 101, and the electrostatic latent image on the photoconductive drum 1 is developed.

Figure 6:
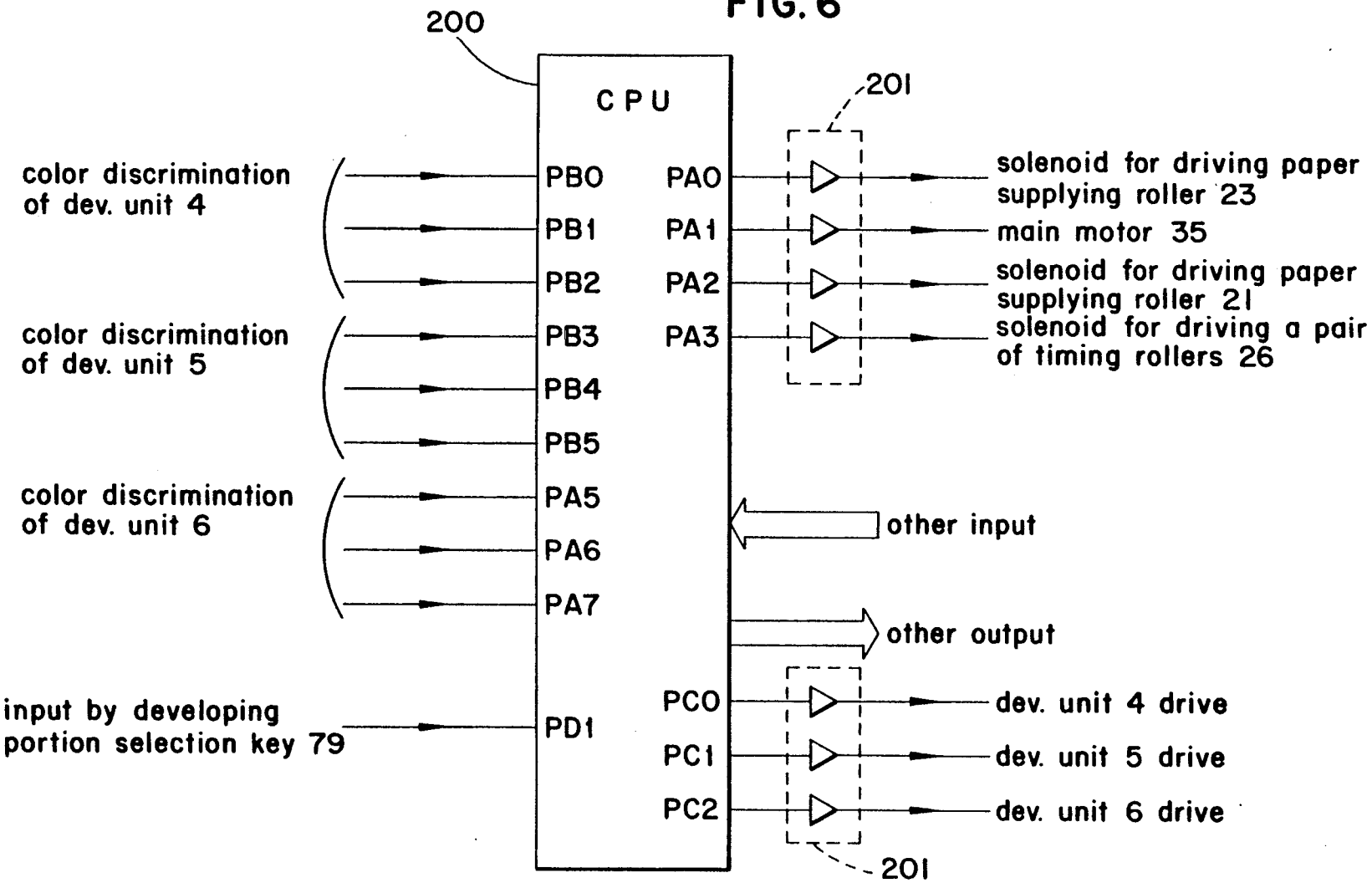
FIG. 6 is a control circuit diagram for the first embodiment of the device of the present invention.

FIG. 6 is a brief control circuit diagram for the first embodiment of the present invention. Item 200 is a one-chip microcomputer with an internal A/D converter; item 201 is an drive integrated circuit (IC) for operating main motor 35, timing roller pair 26 and the like. Main motor 35, solenoids for driving paper supplying rollers 21 and 23, and solenoids for driving timing roller pair 26 are controlled via the signals output from output ports PA0, PA1, PA2 and PA3 of the aforesaid one-chip microcomputer 200. Items PC0, PC1 and PC2 are similar output ports used to control the clutches that operate developing units 4, 5 and 6. Items PB0 through PB5 and PA5 through PA7 are input ports for inputting 3-bit code signals used for discriminating the color of the toner accommodated in developing units 4, 5 and 6 and to determine whether or not said developing units are installed. Developing portion selection signals are input to input port PD1 by operating the developing portion selecting key 79. One-chip microcomputer 200 input other data related to the control of the copy machine, or outputs data for peripheral circuits.

Figure 7:
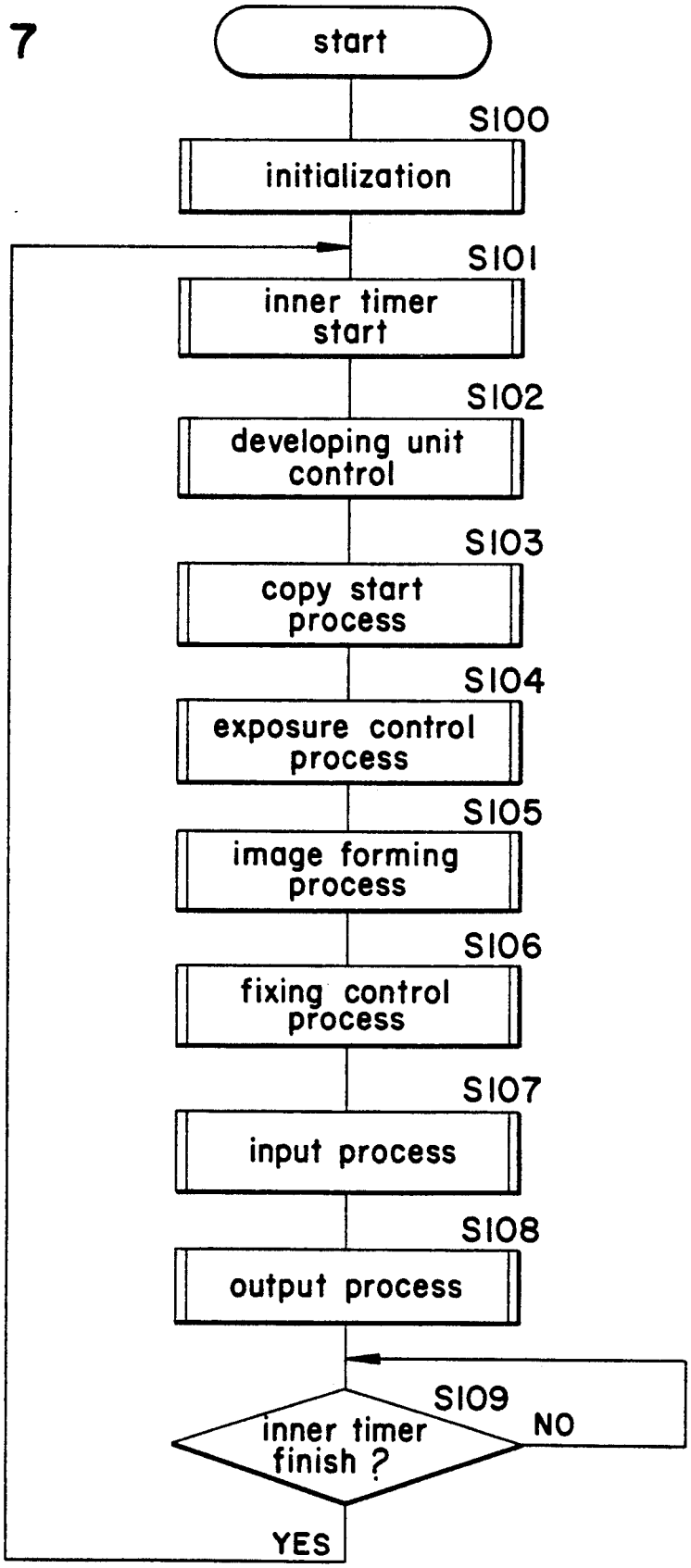
FIG. 7 is a flow chart showing the main routine for the entire copy machine using the first embodiment of the present invention.

FIG. 7 is a main flow chart showing all copy machine operations of the first embodiment of the present invention.

When power is applied to the copy machine from a power source, internal registers, all types of inner timers and the like are initialized (step S100). Then, the inner timers are started in step S101, and the time for subsequent processes is set.

In step S102, the developing unit control routine is executed. This routine will be described in detail later.

In step S103, copy start processes are executed. These processes are described in detail later.

In steps S104 through S108, the exposure control process, image forming process, fixing control process, input process, other output processes and processes related to copy machine copy operation are executed. Descriptions of the aforesaid processes are omitted since they are outside the purport of the present invention and involve commonly known technology. In step S109, a determination is made as to whether or not the inner timer started in step S101 has completed. If said timer has completed, the routine returns again to said step S101, and if said timer has not completed, it remains on standby status.

Figure 8A:
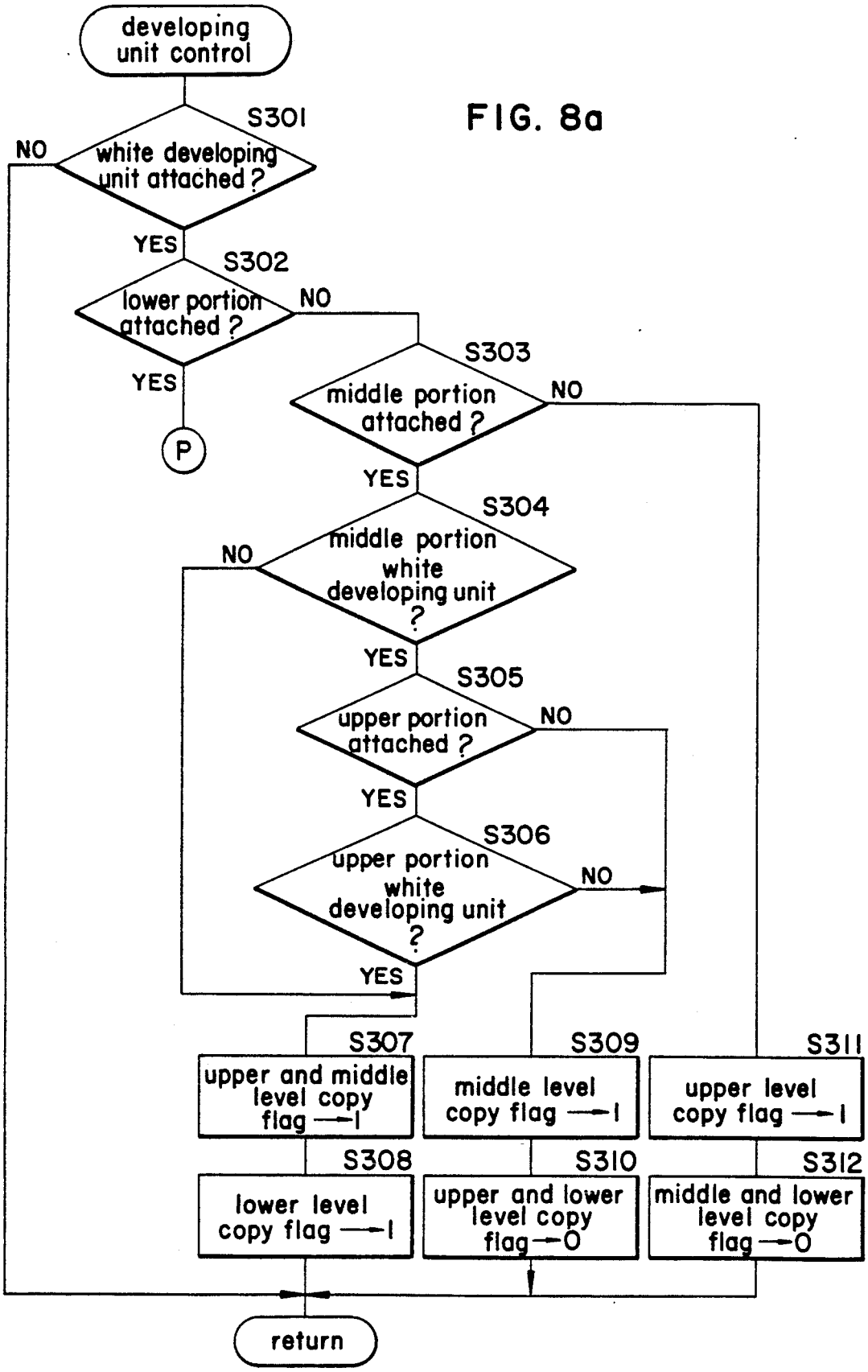
FIGS. 8(*a*), 8(*b*) and 8(*c*) are flow charts showing the developing device control routine in the first embodiment of the invention.
Figure 8C:
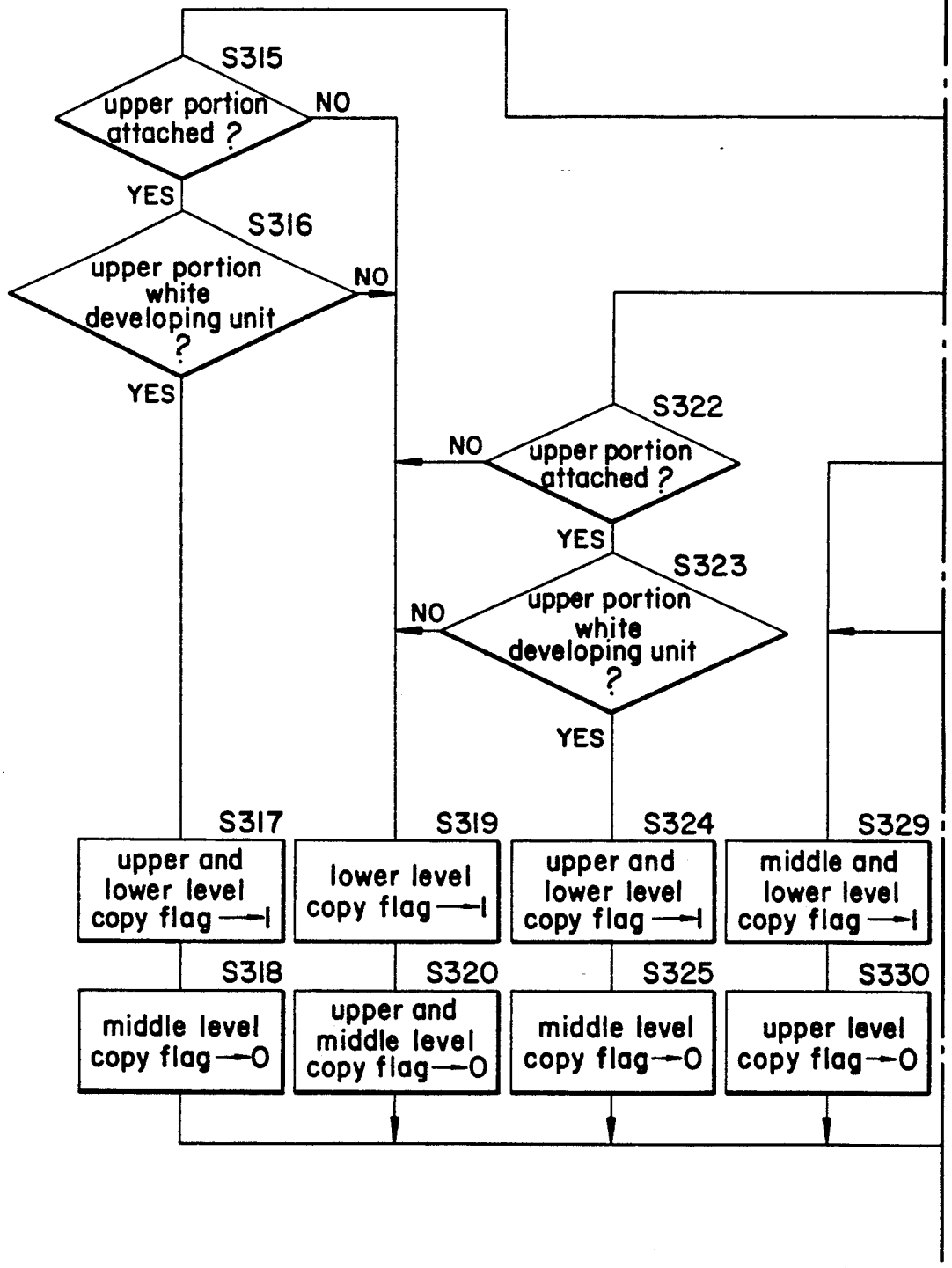

FIGS. 8(*a*) and 8(*b*) are flow charts of the developing unit control routine.

First, in step S301, a determination is made as to whether or not the white developing unit is installed in the copy machine based on the toner color discrimination signals. If the white developing unit has not been installed, this routine terminates. If the white developing unit has been installed, the routine advances to step S302 where a determination is made as to whether or not the developing unit is installed in lower developing portion 600. If the developing unit has not been installed in lower developing portion 600, the routine continues to step S303, while if the unit has been installed in lower developing portion 600 the routine advances to step S313.

In step S303, a determination is made as to whether or not a developing unit has been installed in middle developing portion 500. If a unit has not been installed in developing portion 500, the determination is in agreement with the determination made in the previous step S302, and it is determined that only the white developing unit is installed in the upper developing portion 400. Then the routine advances to step S311 where the upper level copy flag is set at 1, then in step S312 the middle and lower level copy flags are both set at 0. In consequence, copying is enabled in upper developing portion 400, and copying is disabled in middle and lower developing portions 500 and 600.

When a developing unit is found to have been installed in the middle developing portion 500 in the previously described step S303, the routine continues to step S304 and a determination is made as to whether or not the developing unit installed in the middle developing portion is the white developing unit. If the white developing unit is not installed in middle developing portion 500, the white developing unit is determined to be installed in the upper developing portion 400, and in step S307 the middle and upper level copy flags are set at 1, then in step S308 the lower level copy flag is set at 0. If the white developing unit is installed in middle developing portion 500, the routine continues to step S305 where a determination is made as to whether or not a developing unit is installed in the upper developing portion 400. If a developing unit is installed in the upper developing portion 400 and said developing unit is determined to be the white developing unit is step S306, white developing units are installed in both upper and middle developing portion 400 and 500, therefore the same processes are executed in steps S307 and S308. When a developing unit is found to not have been installed in upper developing portion 400 in the previously described step S305, only a white developing unit is determined to be installed in middle developing portion 500. Further, when a nonwhite developing unit is determined to have been installed in upper developing portion 400 in step S306, it is determined that the white developing unit has been installed in middle developing portion 500, and a nonwhite developing unit (hereinafter referred to as "color developing unit") is determined to have bee installed in upper developing unit 400. Accordingly, when the determinations in steps S305 and S306 are NO, the routine in both cases continues to step S309 where the middle level copy flag is set at 1, then the upper and lower level copy flags are at 0 in step S310.

When a developing unit is found to have been installed in lower developing portion 600 in the previously described step S302, the routine continues to step S313, as shown in FIG. 8(*b*). In step S313, a determination is made as to whether or not the developing unit installed in lower developing portion 600 is a white developing unit. If the installed unit is a white developing unit, a determination is then made, in step S314, as to whether or not a developing unit has been installed in middle developing portion 500. If a unit has not been installed in middle developing portion 500, the routine then continues to step S315, where a check is made to determine whether or not a developing unit has been installed in upper developing portion 400. If a unit has been installed in upper developing portion 400, a determination is made in step S316 as to whether or not said installed unit is a white developing unit, and if the installed unit in developing portion 400 is found to be a white developing unit, the routine advances to step S317 because a developing unit has not been installed in middle developing portion 500 and a white developing unit is installed in lower developing portion 600. In the aforesaid step S317, the upper and lower level copy flags are set at 1, and in step S318 the middle level copy flag is set at 0. When the determination in the previously described step S315 is NO, a white developing unit is determined to be installed only in lower developing portion 600. Further, when the determination in step S316 is NO, a developing unit is not installed in middle developing portion 500, a color developing unit is installed in upper developing portion 400 and a white developing unit is installed in lower developing portion 600, so the routine continues to step S319 where the lower level copy flag is set at 1, then in step S320 the upper and middle level copy flags are set at 0.

When it is determined, in the previously mentioned step S314, that a developing unit has been installed in middle developing portion 500, a check is made in step S321 to determine whether or not said installed unit is a white developing unit. If said installed unit is not a white developing unit, the routine continues to step S322 where a determination is made as to whether or not a developing unit has been installed in upper developing portion 400. If the result of the aforesaid determination is that a developing unit is installed in upper developing portion 400, a check is made in step S323 to determine if said installed unit is a white developing unit. If a white developing unit has been installed in upper developing portion 400, white developing units have been installed in both upper and lower developing units 400 and 600, and a color developing unit has been installed in middle developing portion 500, therefore, in step S324, the upper and lower level copy flags are set at 1, and in step S325 the middle level copy flag is set at 0. When the determination in the previously described step S322 is NO, a developing unit is not installed in the upper developing portion 400, a color developing unit is installed in the middle developing portion 500 and a white developing unit is installed in the lower developing portion 600 respectively. Further, when the determination in step S323 is NO, color developing units are installed in upper and middle developing portions 400 and 500, and a white developing unit is installed in lower developing portion 600, and, therefore, the process in steps S319 and S320 are executed.

When the check run in step S321 determines that a white developing unit is installed in middle developing portion 500, the routine advances to step S326 and a determination is made as to whether or not a developing unit has been installed in upper developing portion 400. When a developing unit has been installed in upper developing unit 400, a check is made in step S327 to determine whether o not said installed unit is a white developing unit. If the unit installed in upper developing unit 400 is a white developing unit, white developing units are installed in upper, middle and lower developing portions 400, 500 and 600 respectively. Accordingly, in step S328, the upper, middle and lower level copy flags are all set at 1. When the determination in the previously described step S326 is NO, a developing unit is not installed in upper developing portion 400, and white developing units are installed in middle and lower developing portions 500 and 600. Also, when the determination in step S327 is NO, a color developing unit is installed in upper developing portion 400, and white developing units are installed in middle and lower developing portions 500 and 600. Accordingly, the middle and lower level copy flags are set at 1 in step S329, and the upper level copy flag is set at 0 in step S330.

When a White developing unit is not installed in lower developing portion 600 in step S313, the routine advances to step S331, and a determination is made as to whether or not a developing unit has been installed in middle developing portion 500. If a developing unit has been installed in middle developing portion 500, a check is run in step S332 to determine if said installed unit is a white developing unit. If a white developing unit has been installed in middle developing portion 500, another check is made in step S333 to determine whether or not a developing unit is installed in upper developing portion 400. If the unit installed in upper developing portion 400 is a white developing unit, the determination in step S334 is YES, and since white developing units are installed in upper and middle developing portions 400 and 500 and a color developing unit is installed in lower developing portion 600, the routine continues to step S328 where the upper, middle and lower level copy flags are set at 1. If the determination in the previously described step S332 is NO, a white developing unit is installed in upper developing portion 400 and color developing units are installed in middle and lower developing portions 500 and 600 respectively, therefore the routine continues to step S328. Further, when the determination in step S333 is NO, it indicates that a developing unit is not installed in upper developing portion 400, a white developing unit is installed in middle developing portion 500, and a color developing unit is installed in lower developing portion 600. Furthermore, when the determination in step S334 is NO, it indicates that color developing units are installed in upper and lower developing portions 400 and 600, a white developing unit is installed in middle developing portion 500. Accordingly, in both cases the routine advances to step S335 where the middle and lower level copy flags are set at 1, then the upper level copy flag is set at 0 in step S336.

When the determination in the aforesaid step S331 is NO, a white developing unit is installed in upper developing portion 400, a developing unit is not installed in middle developing portion 500 and a color developing unit is installed in lower developing portion 600. Therefore, in step S337, the upper and lower level copy flags are set at 1, and the middle level copy flag is set at 0 in step S338.

Figure 9:
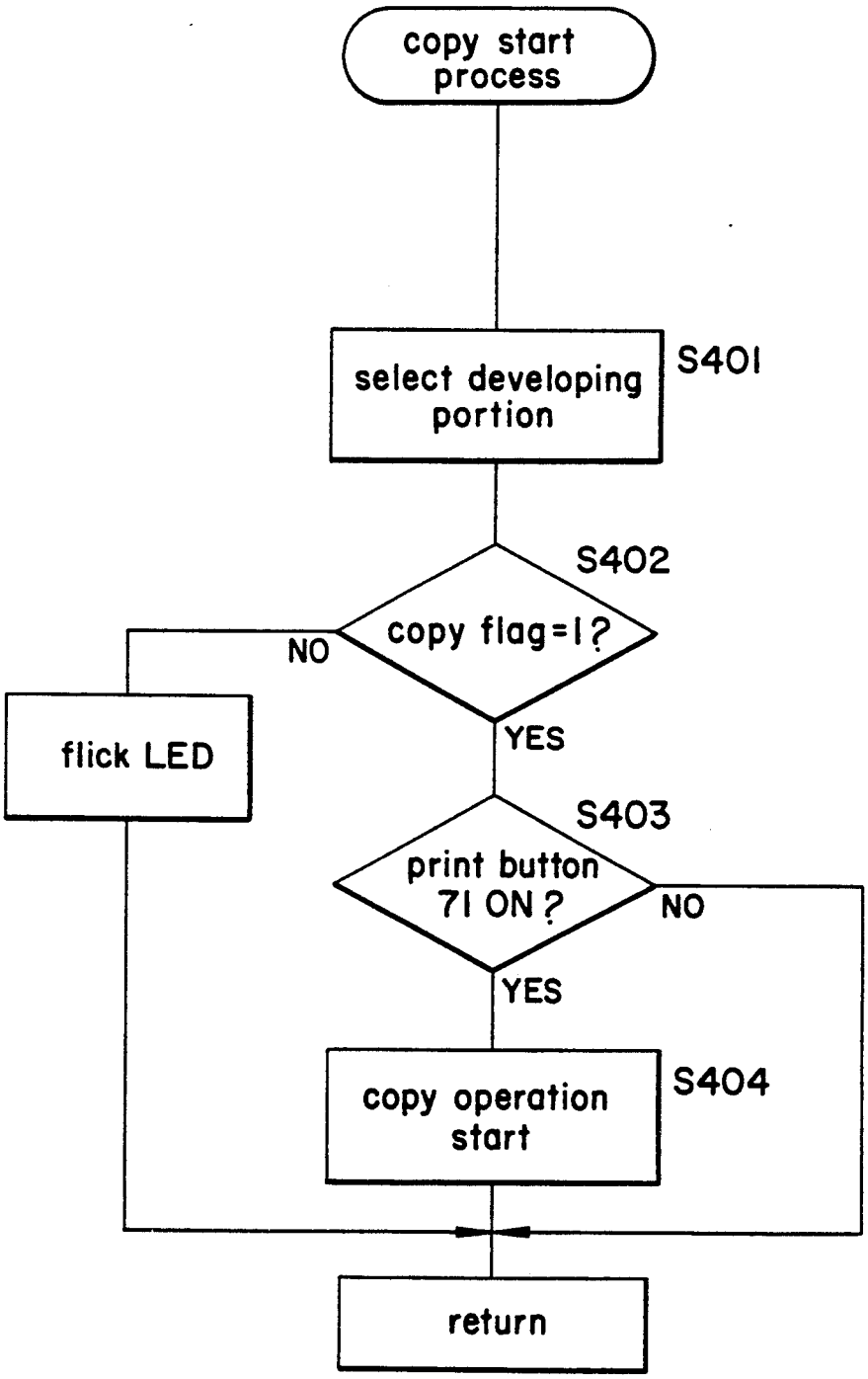
FIG. 9 is a flow chart showing the copy START process routine of the first embodiment of the invention.

FIG. 9 is a flow chart showing the copy start process routine.

In step S401, a check is made to determine which developing portion has been selected by the user, and the color display LED group 80 is actuated to indicate the toner color of the developing unit installed in the user-selected developing portion. Next, in step S402, a check is run to determine whether or not the copy flag for the user-selected developing portion is set at 1. If the copy flag is set at 1, then a check is made in step S403 to determine if the print button is ON. If the print button is ON, the copy operation is started in step S404.

If the copy flag is not set at 1 in step S402, the LED corresponding to the toner color of the developing unit installed in the user-selected developing portion flickers to indicate copying via the developing unit installed in the user-selected developing portion has been disabled, thereby preventing copying by the aforesaid developing portion, and the routine returns to the starting point.

For example, when a developing unit accommodating a red toner is installed in the upper developing portion, a developing unit accommodating white toner is installed in the middle developing portion and a developing unit containing a black toner is installed in the lower developing portion, the upper developing portion is selected by the user, the LED 80 indicating red color toner flickers to inform the user that copying by the upper developing portion is prevented.

A second embodiment of the present invention is described hereinafter.

Figure 10:
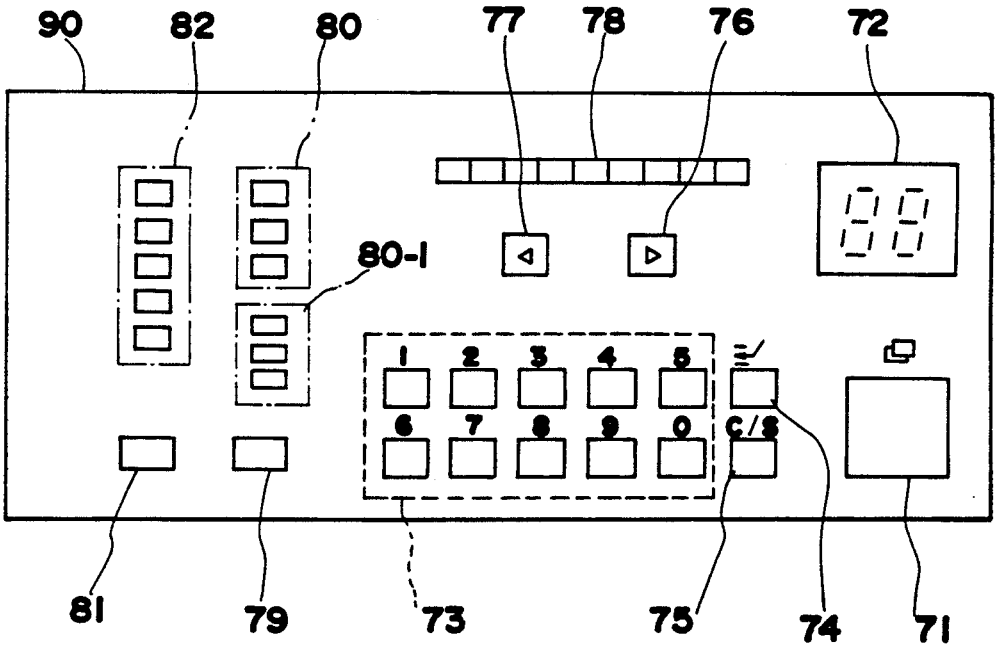
FIG. 10 is a plan view of control panel 90 for the second embodiment of the image forming apparatus of the present invention.

In the second embodiment of the copy machine, a copy-prohibited LED group 80-1 is provided below the color display LED group 80 for indicating the toner color of the developing unit installed in the developing portion selected via selection key 79, said copy-prohibited LED group 80-1 being provided to indicate the toner color in the developing unit installed in the developing portion is inhibited from operating, as shown in FIG. 10. With the exception of the aforesaid point, the construction of the second embodiment of the copy machine is identical to that of the first embodiment.

The construction and operation of the developing units, control circuit and the main flow for all copy machine operation are identical to those described in detail for the first embodiment and are thus omitted herein.

Aspects of the second embodiment which differ from those of the first embodiment are described hereinafter with reference to FIGS. 8(*a*) and 8(*b*). Developing portions having copy flags set at 0 are indicated to the user at the time developing unit installation in the developing portion is completed. That is, the copy-prohibited LED group 80-1 corresponding to developing portions with copy flags set at 0 flicker before the user selects the developing portion via selection key 79, so as to inform the user which developing portions are inhibited from copying.

Figure 11:
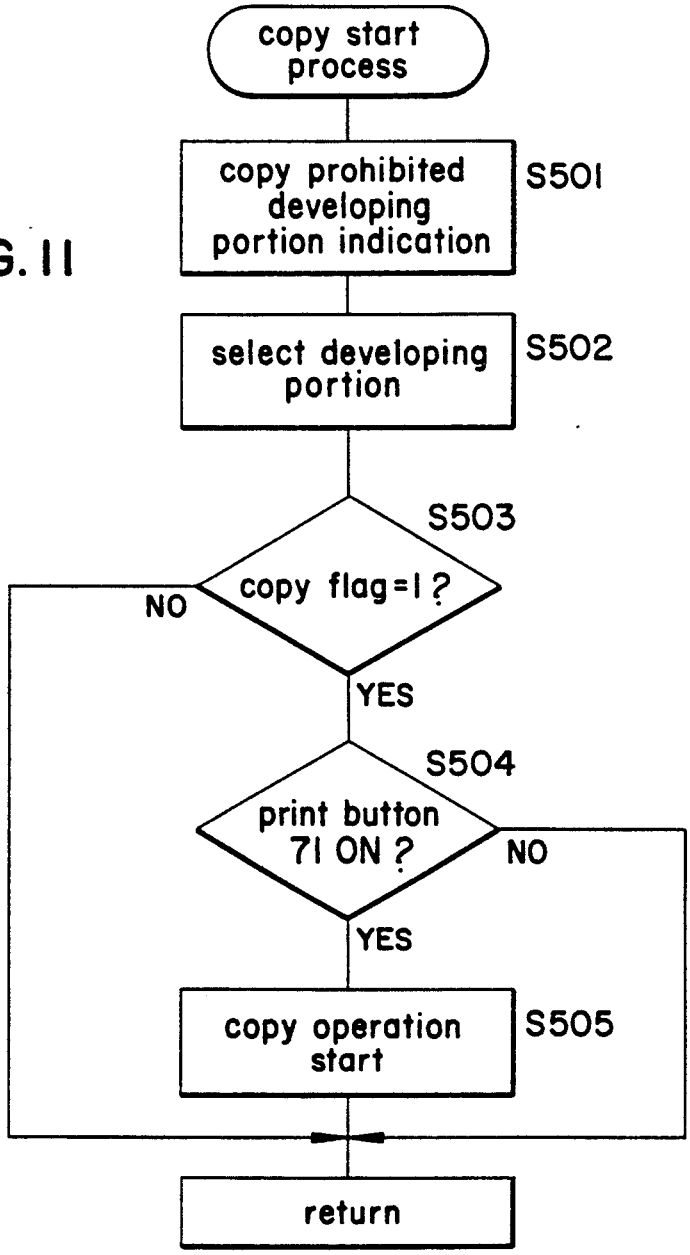
FIG. 11 is a flow chart showing the copy START process routine for the second embodiment of the invention.

FIG. 11 is a flow chart showing the copy start process routine for the second embodiment.

In step S501, the copy-prohibited LED 80-1 corresponding to the toner color of the developing unit installed in developing portion with copy flags set at 0 are made to flicker. In step S502, the LED corresponding to the toner color of the developing unit installed in the user-selected developing portion is switched lighted. In step S503, a check is made to determine whether or not the copy flag of the selected developing portion is set at 1, and if said flag is set at 1, a check is made in step S504 to determine whether or not the print button is ON. If the print button is ON, the copy operation starts in step S505.

If the copy flag is not set at 1 in step S503, the routine returns to the origin.

Figure 12:
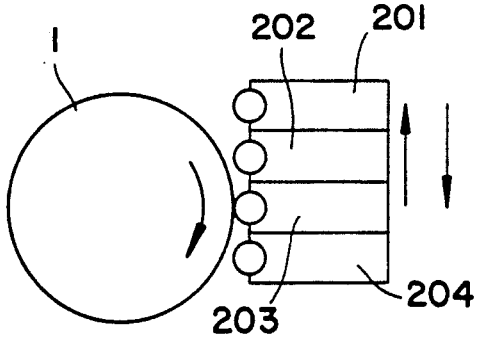
FIG. 12 is a side elevation view of a further embodiment of the present invention.

Although the first and second embodiments have been described in terms of three developing units in a vertical arrangement of upper, middle and lower level disposition, the present invention may be adapted to allow selection of developing device via an elevator type method for raising and lowering a single unit comprising a plurality of developing units 201 to 204 disposed in a vertical arrangement, as shown in FIG. 12.

Further, although the first and second embodiments display the toner color of the developing units installed in the developing portions having copy flags set at 0, i.e., that are in the copy disabled state, so as to prohibit operation of said developing units, the toner color of the developing units installed in the copy-disabled developing portions may be displayed without prohibiting operation of said developing units.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a photoreceptor rotatable in a predetermined direction;

a plurality of developing portions arranged one by one in the direction of the photoreceptor rotation;

a plurality of developing units attachable to the developing portions respectively for accommodating different kinds of developer;

detecting means for detecting attachment of at least one of the plurality of developing units accommodating a specific kind of developer; and control means responsive to said detecting means for regulating operation of the developing portions to which the developing units accommodating the developer are attached except for at least one of the plurality of developing units accommodating the specific kind of developer.

2. An image forming apparatus as claimed in claim 1 wherein said control means prohibits the operation of the developing portions positioned at upstream side of the developing portions to which the developing unit accommodating the specific developer is attached with respect to the direction of the photoreceptor rotation.

3. An image forming apparatus as claimed in claim 2 wherein the specific kind of developer is a white developer.

4. An image forming apparatus as claimed in claim 2 wherein said control means further prohibits the operation of the developing portions to which the developing units are not attached.

5. An image forming apparatus comprising:

a photoreceptor rotatable in a predetermined direction;

a plurality of developing portions arranged one by one in the direction of the photoreceptor rotation;

a plurality of developing units attachable to the developing portions respectively for accommodating different kinds of developer;

detecting means for detecting kinds of developer accommodated within the developing units which are respectively attached to the developing portions;

first control means for forming a visible image on the photoreceptor by operating either of the developing portions; and second control means for prohibiting the operation of the developing portions positioned at upstream side of the developing portion to which the developing unit accommodating a specific kind of developer is attached with respect to the direction of the photoreceptor rotation.

6. An image forming apparatus as claimed in claim 5 wherein said control means further prohibits the operation of the developing units in the developing portions to which the developing units are not attached.

7. An image forming apparatus as claimed in claim 6 wherein the specific kind of developer is white developer.

8. An image forming apparatus as claimed in claim 5 further comprising selecting means for selecting at least one developing portion from the plurality of the developing portions.

9. An image forming apparatus as claimed in claim 8 further comprising display means for displaying the kinds of the developer accommodated within the developing units attached to the developing portions selected by said selecting means.

10. An image forming apparatus as claimed in claim 9 wherein said display means further displays a special information when the operation of the developing portions selected by the selecting means is prohibited by the second control means.

11. An image forming apparatus as claimed in claim 5 further comprising first display means for displaying the kinds of the developer accommodated within the developing units attached to the developing portions the operation of which is prohibited by the second control means.

12. An image forming apparatus as claimed in claim 8 further comprising second display means for displaying the kinds of the developer accommodated within the developing units attached to the developing portions selected by said selecting means.

13. In an image forming apparatus comprising a photoreceptor rotatable in a predetermined direction, a plurality of developing portions arranged one by one in the direction of the photoreceptor rotation, and a plurality of developing units attachable to the developing portions respectively for accommodating different kinds of developer, a method comprising the steps of:

detecting the attachment of the developing units accommodating a specific kind of developer; and prohibiting the operation of the developing units in the developing portions positioned at upstream side of the developing portion to which the developing unit accommodating the specific developer is attached with respect to the direction of the photoreceptor rotation.

14. A method as claimed in claim 13 further comprising the steps of prohibiting the operation of the developing portions to which the developing units are not attached.

* * * * *